US006182874B1

(12) United States Patent
Feldman, Jr.

(10) Patent No.: US 6,182,874 B1
(45) **Date of Patent: *Feb. 6, 2001**

(54) HIP BELT APPARATUS AND SYSTEM FOR CARRYING A GOLF BAG

(76) Inventor: K. Thomas Feldman, Jr., 1704 Stanford Dr. NE., Albuquerque, NM (US) 87107

( * ) Notice: Under 35 U.S.C. 154(b), the term of this patent shall be extended for 0 days.

This patent is subject to a terminal disclaimer.

(21) Appl. No.: 09/318,672

(22) Filed: May 25, 1999

Related U.S. Application Data

(63) Continuation-in-part of application No. 08/927,449, filed on Sep. 11, 1997, now Pat. No. 5,950,889.

(30) Foreign Application Priority Data

Sep. 11, 1998 (WO) ..... US98/19184

(51) Int. Cl.[7] ..... A45F 3/04; A63B 55/00

(52) U.S. Cl. ..... 224/259; 224/250; 224/625; 224/645; 206/315.3

(58) Field of Search ..... 224/259, 250, 224/625, 645, 644, 643, 662, 264, 262, 651, 626; 206/315.3

(56) References Cited

U.S. PATENT DOCUMENTS 3,050,734 * 8/1962 Dopyera ..... 224/264
4,324,012 * 4/1982 Cannaday ..... 224/264 X
4,648,130 * 3/1987 Kuznetz ..... 455/89
5,042,702 * 8/1991 Douglass ..... 224/901.8
5,064,108 * 11/1991 Headley ..... 224/259
5,205,448 * 4/1993 Kester et al. ..... 224/240
5,361,955 * 11/1994 Gregory ..... 224/907
5,419,473 * 5/1995 Lamar ..... 224/645 X
5,577,648 * 11/1996 Sason et al. ..... 224/264 X
5,632,429 * 5/1997 Cantwell ..... 224/264 X
5,950,889 * 9/1999 Feldman, Jr. ..... 224/259
5,998,771 * 12/1999 Mariano et al. ..... 219/528

* cited by examiner

*Primary Examiner*—Jes F. Pascua
(74) *Attorney, Agent, or Firm*—Richard A. Bachand

(57) ABSTRACT

An apparatus and system for carrying a weight-bearing object, such as a golf bag, has a hip belt member for supporting the weight bearing object and reducing the load on the user's back and shoulders. An attachment member is coupled to the hip belt member for attaching the hip belt member to the weight-bearing object, and a belt fastener connects the hip belt member about the user's waist. Additional shoulder straps can be utilized to lift the object and stabilize and reduce movement of the weight-bearing object about the user. Hip belt members and shoulder pads can have vent slots for ventilation and improved comfort, while being worn in hot weather. Hip belt members and shoulder pads can have heat storage material added to cool the user, while being worn in hot weather.

36 Claims, 12 Drawing Sheets

HIP BELT APPARATUS AND SYSTEM FOR CARRYING A GOLF BAG

CROSS REFERENCE TO RELATED APPLICATIONS

This application is a continuation-in-part application of U.S. patent application Ser. No. 08/927,449, filed Sep. 11, 1997, now U.S. Pat. No. 5,950,889 which is incorporated herein by reference.

BACKGROUND OF THE INVENTION

1. Field of the Invention

This invention relates in general to sport and utility bags, and in particular to golf bags having various straps for reducing the stress placed on a user's shoulders and back.

2. Background

Golfers traditionally use golf bags to carry golf clubs, golf accessories such as golf balls, golf tees, umbrellas, raincoats, golf towels, as well as food and beverage items, among other things. A fully loaded golf bag can weigh between 20 to 60 lbs. Hence, carrying a golf bag can be physically demanding to the caddie or golfer while golfing.

Conventional golf bags have a single shoulder strap attached to the central portion and top open portion of the golf bag. This shoulder strap permits the golfer to carry the golf bag over one shoulder, which tends to concentrate the weight of the bag on the golfer's shoulder and back. Depending on the weight of the bag, carrying a golf bag with a conventional shoulder strap can be uncomfortable and create muscle aches and soreness in the golfer's shoulder and back.

U.S. Pat. No. 5,038,984 teaches a dual strap carrying system for a golf bag which provides two shoulder straps to about a user's waist, and an attachment member is coupled to the hip belt member for attaching the hip belt member to the weight-bearing object.

The attachment member can comprise first and second attachment members, each having an adjustable fastener. The attachment members can be attached to the hip belt member at first and second attachment points on the central or hip portion of the hip belt. The attachment member may be attached by being directly sewn to the weight-bearing object. Alternatively the belt member may be fitted into a slot which may be provided on the golf bag.

The hip belt member can be padded along the central portion, as well as the first and second hip portions, to conform to the user's hips and improve the user's comfort. The first and second waist straps can be adjustable in length so that people having different waist sizes can use the hip belt member. The belt fastener can conveniently be a bayonet-type snap clasp having a male end and a female end for simple attachment and removal of the hip belt member about the user's hips, or other suitable fastener. The padded hip belt also serves as a cushion between the golf bag and the golfers back so he is cushioned from the clubs in the bag.

In order to keep the golfer cooler while wearing the hip belt in hot weather, the hip belt member may be made with ventilation holes or slots to allow some air flow through the belt while being worn. Integrating an open mesh fabric into the padded belt member may provide such ventilation holes or slots. The padded belt member may be made of hand-sewn layers of foam and fabric. It may also be made of compression-molded foam and fabric. In order to reduce bending and curling downward in the stress concentration areas where the attachment members and weight bearing object are attached, the hip belt may be fitted with stiffeners inside or on the outside of the belt. Such stiffening may also be provided by employing stronger, stiffer foam and fabric or a layer of stiff solid material on the outside layers of the belt while softer foam and fabric are used on the inner layers which contact the golfers body. Further, the hip belt and shoulder straps may be provided with a thin layer of heat storing material on their surfaces where they contact the user to absorb heat from the user while being worn. The heat storing material is cooled when not being worn by natural convection to the ambient air and by evaporation of sweat absorbed from the user on the surfaces.

According to another broad aspect of the invention, a system for carrying a weight-bearing object, such as a golf bag, is presented including a hip belt member, a belt fastener, an attachment member, and a shoulder strap. The hip belt member is provided for supporting the weight-bearing object, and the belt fastener connects the first end of the hip belt member to the second end of the hip belt member about a user's waist. The attachment member is coupled to the hip belt member for attaching the hip belt member to the weight-bearing object, and the shoulder strap is provided for lifting the bag into position and stabilizing the weight-bearing object about the user, the shoulder strap having at least one end coupled to the weight-bearing object.

The attachment member can include a first attachment member for coupling the hip belt member to a top portion of the weight-bearing object about a first attachment point, and a second attachment member for coupling the hip belt member to a central portion of the weight-bearing object about a second attachment point. The shoulder strap can distribute the weight of the bag onto both shoulders. The golf bag is provided with a back cushion or pillow that conforms to the lower back of the golfer.

U.S. Pat. No. 5,042,702 teaches a belt member having a hook and loop fastening system which mates with a corresponding piece of hook and loop attached to a golf bag. The belt member is intended to be worn at all times during play. One of the drawbacks that exist with this belt member is that it is designed to be worn throughout the golfing activity, which could adversely affect the golfer's normal swing or putting stance during play.

U.S. Pat. No. 5,419,473 teaches a golf bag with lumbar support and a waistband which is designed to attach to the lower portion of the golf bag. The golf bag is carried vertically along the golfer's back centered between the golfer's shoulders. A lumbar pad is provided to distribute the weight of the bag to the user's lower back. One drawback of this system is that the bag is vertically oriented, which inhibits the golfer's ability to easily remove or insert golf clubs into the golf bag, or access other items stored in the golf bag. A golfer may also be inhibited from easily bending forward to, for example, pick up a golf ball, drink from a drinking fountain, or tie shoelaces.

What is needed is an apparatus and system for carrying a golf bag which reduces most of the load on the golfer's shoulders and back by transferring the weight of the load to the hips and legs, while maintaining an orientation of the golf bag which permits easy access to the items stored therein. The apparatus and system should also permit the golfer to easily remove the bag and its associated components so that the golfer can enjoy a natural golf swing unencumbered by the golf bag carrying apparatus.

It is with the shortcomings of the existing art in mind that the significant improvements and advancements of present invention were developed.

SUMMARY OF THE INVENTION

The hip belt apparatus and system of the present invention has solved the above problems. According to one broad aspect of the invention, an apparatus for carrying a weight-bearing object, such as a golf bag, is presented and includes a hip belt member, a belt fastener, and an attachment member. The hip belt member is provided for supporting the weight-bearing object about a user's hips, and has a first end and a second end. The belt fastener removably connects the first end of the hip belt member to the second end of the hip belt member about the user's waist. The attachment member is coupled to the hip belt member for attaching the hip belt member to the weight-bearing object. In one embodiment of the invention, the attachment member comprises a first attachment member for coupling the hip belt to the weight-bearing object about a first attachment point, and a second attachment member for coupling the hip belt member to the weight-bearing object about a second attachment point. The center of gravity of the weight-bearing object is positioned between the first and second attachment points.

According to another broad aspect of the invention, an apparatus for carrying a weight-bearing object, such as a golf bag, is presented and includes a hip belt member for supporting the weight-bearing object about a user's hips. The hip belt member has a central portion, a first hip portion, and a second hip portion. A first waist strap is coupled to the first hip portion, and a second waist strap is coupled to the second hip portion. A belt fastener connects the first waist strap to the second waist strap include a first and second shoulder strap. The first shoulder strap has a central portion, a first strap for attachment to the first attachment point, and a second strap member for attachment to the second attachment point. The second shoulder strap can have a central portion, a first strap for attachment to the weight-bearing object at a point along the top of the weight-bearing object, and a second strap member for attachment to the second attachment point. In this manner, the golf bag will be oriented substantially horizontal so that its contents are readily accessible by the user.

Further, the first shoulder strap can be provided with a slot member positioned along the first strap for defining a slot adapted to receive the first strap of the second shoulder strap to prevent tangling of the shoulder straps. Another way for preventing the straps from tangling may include threading the two straps through a commercially available clamp-on suspender divider, threading the two straps through a loop-loc® member, or sewing the two straps together where they cross.

One of the advantages of the present invention is that the load of the golf bag on the golfer's shoulders and back is reduced by transferring most of the load to the golfer's hips and legs. At the same time, the golfer's ability to bend over is maintained, while maintaining an orientation of the golf bag that permits easy access to the items stored therein. The golf bag is easily removable so that the golfer can enjoy a natural golf swing unencumbered by the golf bag carrying apparatus.

The foregoing and other features, utilities and advantages of the invention will be apparent from the following more particular description of a preferred embodiment of the invention as illustrated in the accompanying drawings.

DETAILED DESCRIPTION OF THE PREFERRED EMBODIMENT

In accordance with the present invention, a hip belt apparatus and system are presented for carrying a weight-bearing object such as a golf bag. The present invention transfers a substantial portion of the load of the weight-bearing object onto the hips of a person through a hip belt member attached to the weight-bearing object. By transferring the weight to the person's hips, the load on the person's back and shoulders is reduced for improved comfort and reduced fatigue. The hip belt member is adapted to fit snugly about a person's waist and upper portion of their hips to effectively support the weight-bearing object. An optional shoulder strap system can be used in conjunction with the hip belt member to allow the bag to be lifted into position and to improve the stability of the system.

Figure 1:
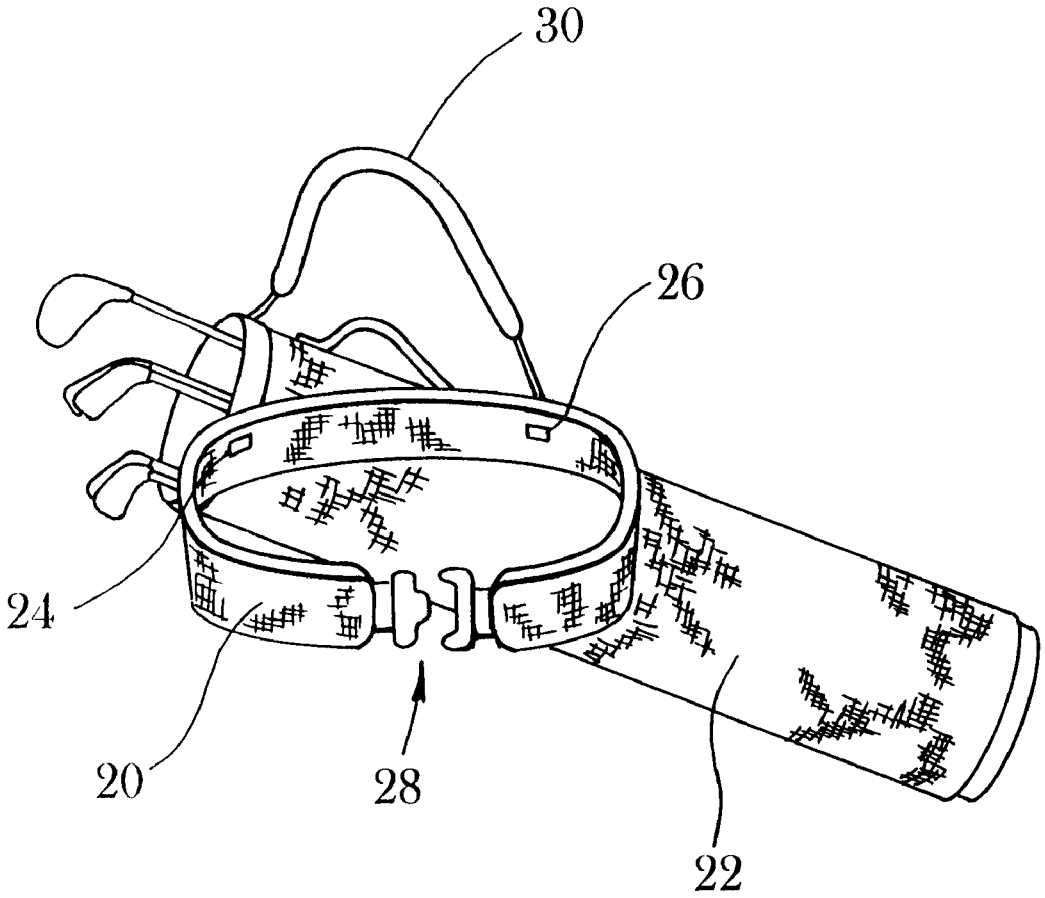
FIG. 1 illustrates an isometric view of the hip belt member of the present invention attached to a golf bag.

FIG. 1 shows a hip belt member 20 attached to a weight-bearing object 22, such as a golf bag. The hip belt member 20 has a first and second point of attachment 24, 26 to the weight-bearing object, thereby distributing the load of the weight-bearing object to the first attachment point 24 and the second attachment point 26 of the hip belt member. The first and second attachment points are respectively coupled to a first and second attachment members, shown in FIG. 2.

The first and second attachment points 24, 26 are ideally attached to at least two points on the weight-bearing object 22 so that the weight-bearing object is properly oriented and its center of gravity resides between the first and second attachment points. In this manner, the load of the weight-bearing object is positioned between the first and second attachment points and distributed therebetween onto the hips and legs of the user.

The hip belt member 20 has a belt fastener 28 to secure the ends of the hip belt member together about the waist and hips of the user. In one example, the belt fastener 28 has adjustable ends so that the hip belt member can be snugly positioned about the user's waist.

Figure 4:
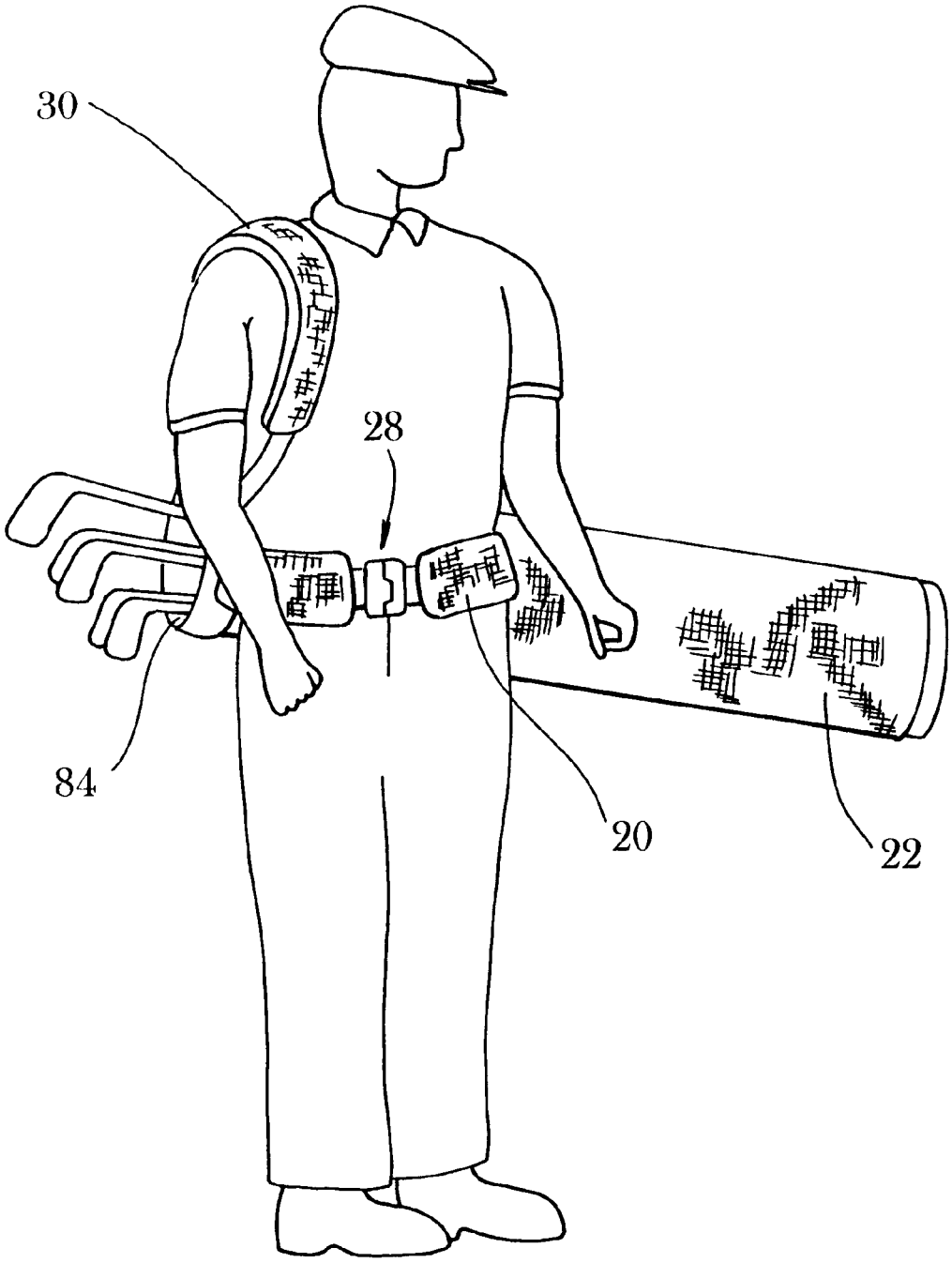
FIG. 4 illustrates a golfer utilizing the hip belt member of the present invention to carry a golf bag.

FIG. 1 shows the weight-bearing object 22 as a golf bag having a conventional single shoulder strap 30. In accordance with the present invention, the hip belt member 20 can be attached to the golf bag and used in conjunction with the conventional shoulder strap, as shown in FIGS. 1 and 4.

Figure 2:
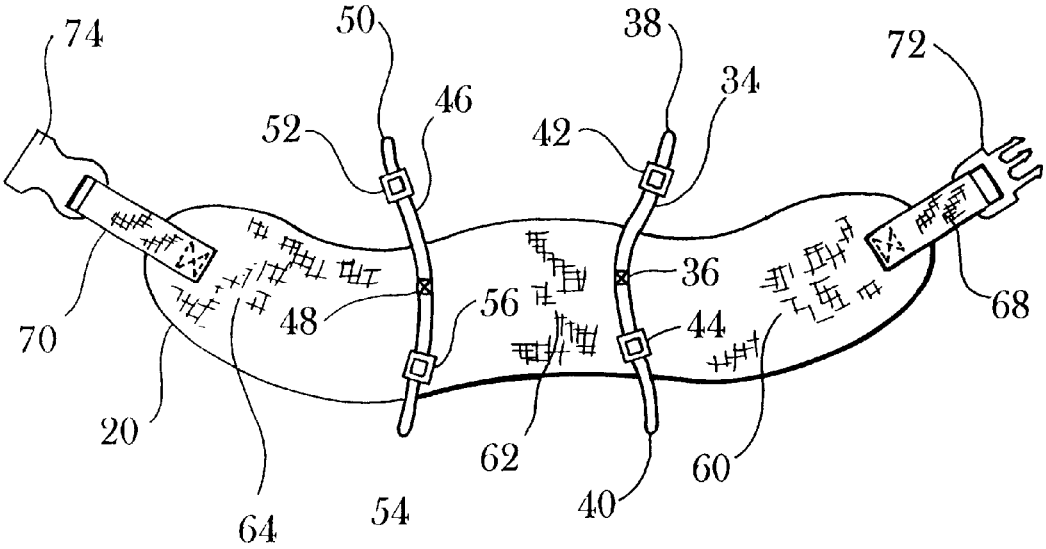
FIG. 2 illustrates a rear elevation view of the hip belt member in accordance with the present invention.

FIG. 2 illustrates a rear view of the hip belt member 20 of FIG. 1. A first attachment member 34 is attached to the hip belt member 20 at a first attachment point 36 using a sewn attachment or other like attachment method. The first attachment member 34 has a first end 38 and a second end 40 for attachment to the weight-bearing object. The first end 38 has a first adjustable fastener 42 which can receive either the first end 38 in a loop configuration, or the second end 40 inserted through the first adjustable fastener 42. Likewise, the second end 40 of the first attachment member 34 has a second adjustable fastener 44 for receiving either the second end 40 in a loop configuration or the first end 38 therethrough. Likewise, a second attachment member 46 secured to the hip belt member through a sew attachment or like attachment method at a second attachment point 48, has a first end 50 with a first adjustable fastener 52, and a second end 54 with a second adjustable fastener 56.

The hip belt member has a first hip portion 60, a central portion 62, and a second hip portion 64. The first and second hip portions are adapted to be positioned about the user's hip (i.e. the lateral parts of the pelvis) to transfer the weight of the weight-bearing object to the hips and the legs of the user. The central portion 62 of the hip belt member couples the first hip portion 60 to the second hip portion 64. This transfers a portion of the weight to the upper rear part of the pelvis and provides a location at which the first and second attachment members 34, 46 may be secured to the hip belt member. Alternatively, the first and second attachment members 34, 46 could be attached to the first and second hip portions 60, 64 to secure the weight bearing object thereto.

The hip belt member also has a first waist strap 68 attached to the first hip portion and a second waist strap 70 attached to the second hip portion which secure adjustable male and female ends 72, 74 of the belt fastener. A sew attachment or other like method can be used to the connect the first and second waist straps 68, 70 to their respective first and second hip portions 60, 64 of the hip belt member 20. The belt fastener, in one embodiment of the invention, is a bayonet-type, side-release snap clasp having an adjustable female end 74 adapted to removably yet securably receive an adjustable male end 72. Both the female end and male end are adjustable along their respective waist straps 68, 70 so that persons having different waist sizes can use the hip belt member. Different lengths of the hip belt member can also be manufactured to accommodate for different waist sizes within the adjustable dimensions provided by the waist straps 68, 70 with adjustable ends 72, 74.

Figure 3:
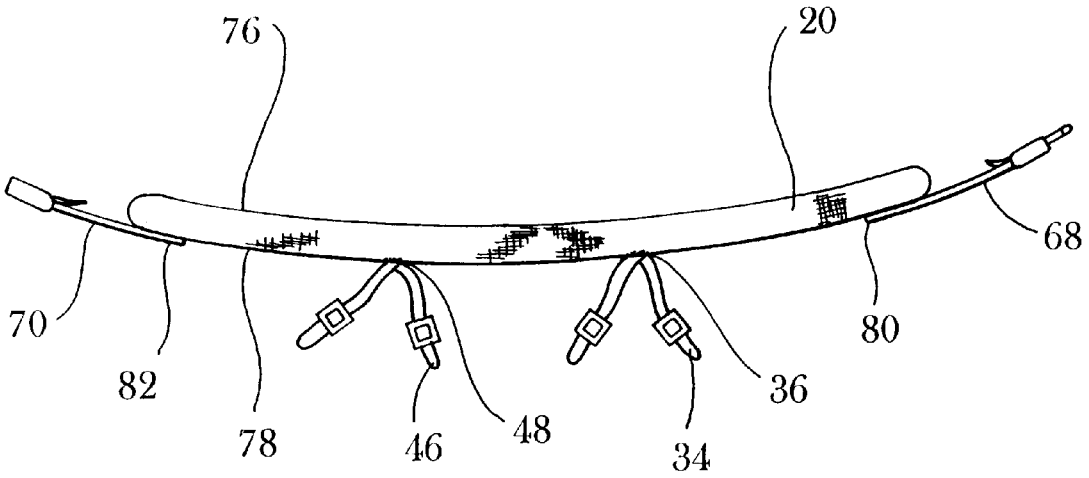
FIG. 3 illustrates a top view of the hip belt member of FIG. 2 in accordance with the present invention.

FIG. 3 illustrates a top view of the hip belt member 20 of the present invention. The hip belt member shown in the embodiment of FIG. 3 is a padded material having an interior surface 76 and an exterior surface 78. A padding or thickness dimension between ⅝ and 1½ inch has been found to be desirable and comfortable. The waist straps 68, 70 and first and second attachment members 34, 46 are affixed to the exterior surface 78 of the hip belt member so that the interior surface 76 of the hip belt member does not contain any interface surfaces which would uncomfortably contact the user's body. As shown in FIG. 3, the first waist strap is attached to the hip belt member through sew or like attachment 80 and the second waist strap is attached through sew or like attachment 82. The first attachment member 34 is attached to the hip belt member through the first attachment point 36, while the second attachment member 46 is attached through the second attachment point 48 on the exterior surface. For a right-handed golfer, as shown in FIG. 4, the first attachment member 34 is attached to the side of the golf bag near its mouth 84, while the second attachment member 46 is attached to the top center of the golf bag. Conversely, for a left-handed golfer, the second attachment member 46 can be attached to the side of the golf bag near its mouth, while the first attachment member 34 can be attached to the top center of the golf bag.

FIG. 4 illustrates a person using the hip belt member 20 of the present invention to carry the weight-bearing golf bag 22 with golf clubs therein. The hip belt member is secured around the hips of the user with the belt fastener 28 in the closed position. As shown in FIG. 4, the shoulder strap 30 of the golf bag can be used to lift the bag into position and to further stabilize the golf bag about the user. As can be seen in FIG. 4, the user has easy access to the contents of the golf bag due to the substantially horizontal orientation of the golf bag. Further, because the hip belt member 20 has a belt fastener 28, the hip belt member can be easily removed as the user sees fit. For instance, if the user was preparing to hit a golf shot, the belt fastener 28 could be disconnected and the hip belt member 20 and shoulder strap 30 could be removed to enable the user to freely move unencumbered by either the hip belt member or the shoulder strap.

Also shown in FIG. 4, the load of the weight-bearing golf bag is now transferred substantially from the user's shoulders and back to the user's hips and legs.

To use the present invention, a user would lift the golf bag and insert an arm into the shoulder strap. The hip belt member 20 would then be positioned about the user's waist and the belt fastener 28 would be latched closed. The adjustable male and female ends along the waist straps could be adjusted to insure a proper fit of the hip belt member about the user's hips. The length of the shoulder strap can be adjusted so that it does not carry a significant amount of the load of the weight-bearing object, but simply acts as a stabilizer, as well as a way to lift the golf bag into position for carrying.

Referring to FIGS. 1 and 4, the hip belt member 20 is attached to the side of the golf bag at the center of gravity of the golf bag so that the golf bag will be balanced and properly oriented. The hip belt member can be attached to the golf bag by the first and second attachment members (FIG. 2) so that the orientation of the bag is higher at the open end 84 of the golf bag where the clubs are accessible. In this manner, any tendency of the golf clubs to fall out of the golf bag will be reduced.

It will be understood that while FIGS. 2 and 3 illustrate two attachment members, the number of attachment members can be varied to accommodate the particular geometry and characteristics of the weight-bearing object to be carried.

A second embodiment of the present invention is shown in FIGS. 5, 6A–6C, and 7, wherein a shoulder support system is used in conjunction with the hip belt member to carry a weight-bearing object such as a golf bag. The shoulder support system assists in stabilizing the load of the weight-bearing object particularly during instances when the user is moving the weight-bearing object.

Figure 5:
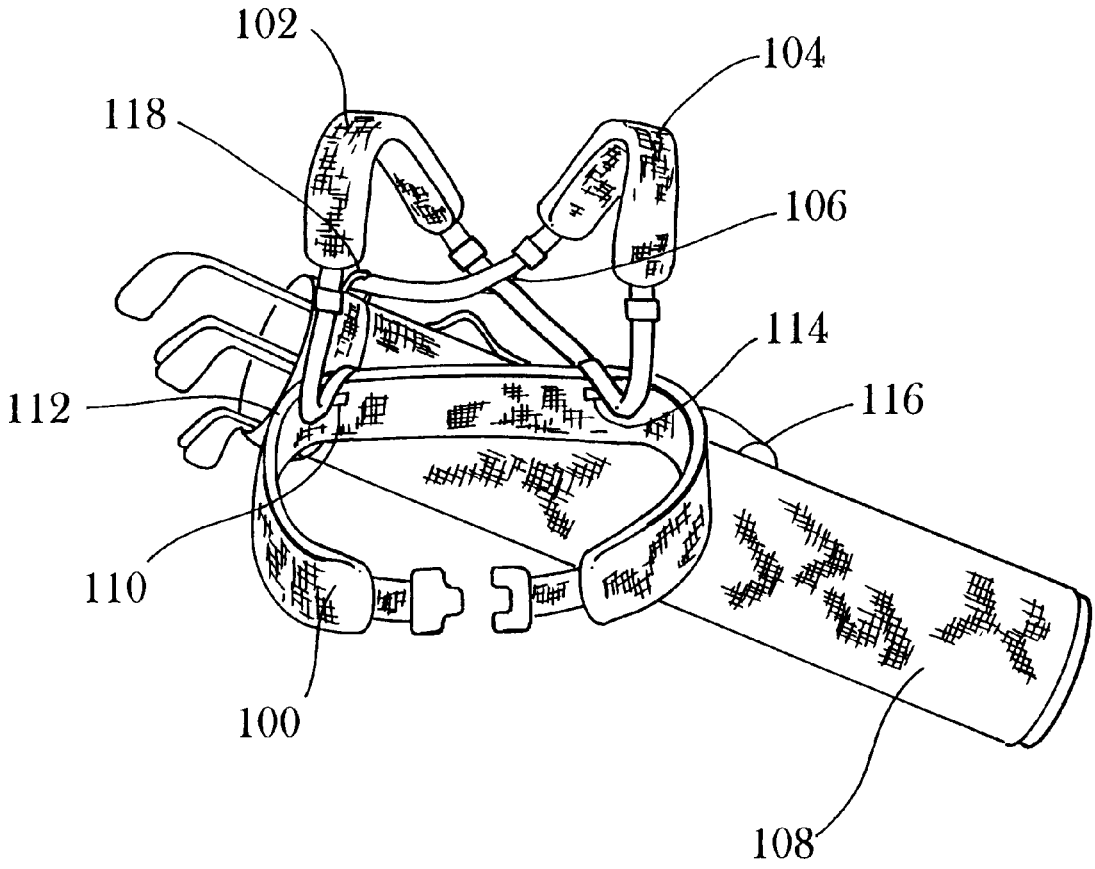
FIG. 5 illustrates an alternative embodiment of the present invention using a right and left shoulder strap in conjunction with the hip belt member of the present invention.

Referring to FIG. 5, the hip belt member 100 of the present invention is shown in conjunction with a right shoulder strap 102 and a left shoulder strap 104 which are overlapped and threaded together. As with the shoulder strap shown in FIGS. 1 and 4, the right and left shoulder straps of the present invention are adjustable so that most of the load of the golf bag can be transferred to and carried by the hip belt member 100. The left and right shoulder straps can be padded where they contact the user's shoulder to improve overall comfort.

In the region where the shoulder straps cross, a slot 106 is provided in one of the shoulder straps through which a portion of the other strap securably passes. The slot keeps the straps from becoming twisted or entangled and makes it easier for the user to insert their arms within the shoulder straps.

In accordance with this embodiment of the present invention, the hip belt member 100 is attached to the weight-bearing object 108 at a first attachment point 110 coupled to the side attachment point 112 near the mouth of the golf bag, and the second attachment point 114 coupled to a central hook 116 of the golf bag. Further, one end of the left shoulder strap 104 is attached to the top hook 118 of the golf bag. The side attachment point 112 of the golf bag supports the bag and prevents the bag from tipping downward or sideways. The side attachment point 112 also provides a point at which the bag can be supported so that the bag is angled upward in its orientation. The side attachment point 112 may be integral to the golf bag, or can be added to the golf bag for attachment to the hip belt member.

By attaching one end of the left shoulder strap 104 to the top hook 118 of the golf bag, upward lift is provided to support the bag from drooping or sagging away from the user. While the top hook attachment point 118 has been shown approximately one quarter of the perimeter of the top portion of the bag away from the side attachment point 112, it is understood that the side attachment point 112 and the top hook attachment point 118 could be located close to one another or opposite of one another along the periphery of the top portion of the golf bag or where needed to keep the bag in balance.

Figure 6A:
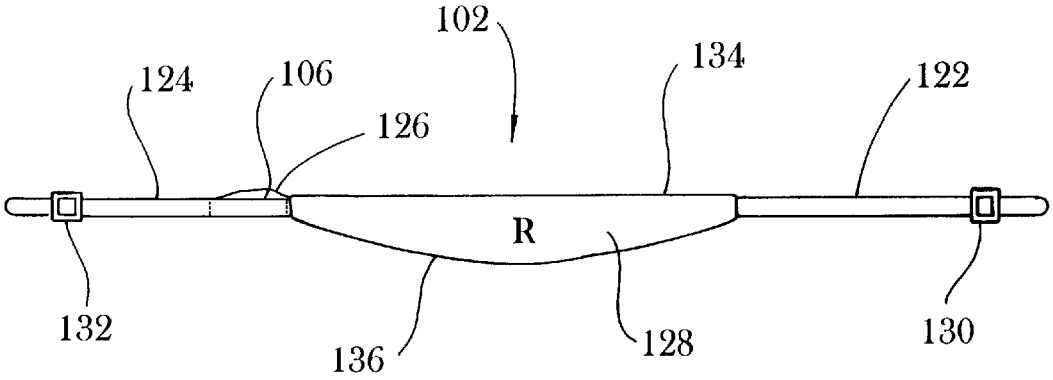
FIG. 6A illustrates a top view of a right shoulder strap of an alternate embodiment of the present invention.
Figure 6B:
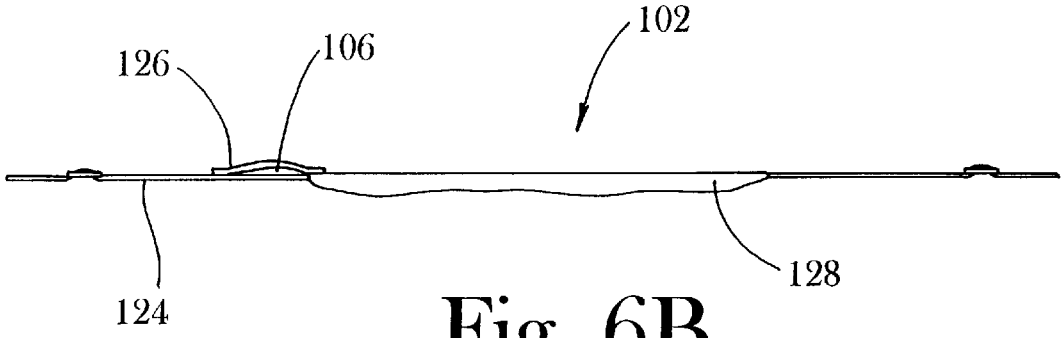
FIG. 6B illustrates a side view of the right shoulder strap of FIG. 6A in accordance with an alternate embodiment of the present invention.
Figure 6C:
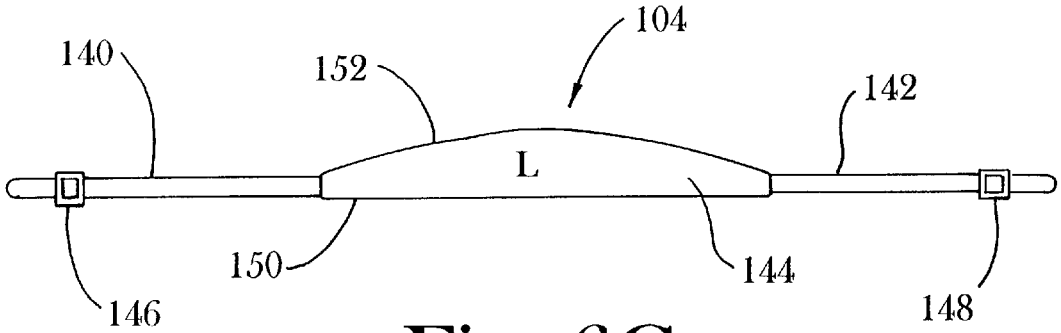
FIG. 6C illustrates a front view of a left shoulder strap of an alternative embodiment of the present invention.

FIGS. 6A–6C illustrate the right and left shoulder straps 102, 104 of the shoulder support system in accordance with the present invention to be used in conjunction with the inventive hip belt member. Referring to FIG. 6A, the right shoulder strap 102 is shown having a first strap 122 and a second strap 124, a slot member 126, a padded central portion 128, and strap adjustable means 130, 132. The first strap 122 is provided for attachment to the hip belt member 100 at the first attachment point 110 as well as the side attachment point 112 of the golf bag. A strap adjustment means 130 is provided on the first strap 122 for adjusting the length of the first strap. The second strap 124 is provided for attachment of the right shoulder strap to the hip belt and the central portion of the bag at the second attachment point 114. The second strap 124 has a strap adjustment means 132 for adjusting the length of the second strap. The right shoulder strap 102 has a padded central portion 128 having a flat side 134 and an arcuate side 136, where the flat side 134 is intended to be worn along the user's shoulder towards the user's neck, while the arcuate side 136 is intended to be worn along the user's shoulder towards the user's arm. The central portion 128 is padded to provide improved comfort, and a ½ to ¾ inch thick padding has been found suitable for this purpose.

A slot member 126 is located on the second strap 124 to receive therein a strap of the left shoulder strap 104, described below. Affixing a small portion of additional strap material over the top of the strap to create a slot or channel 106 therein can form the slot member 126. The width of the slot created should be large enough to accommodate the width of the portion of the left shoulder strap, but small enough to limit the movement of the portion of the left shoulder strap within the slot. FIG. 6B illustrates a side view of the right shoulder strap 102 and shows the slot 106 formed between the slot member 126 and the second strap 124 of the right shoulder strap. While the slot is shown and described with reference to the right shoulder strap, it is understood that the slot could be positioned on either the right or left shoulder strap depending on the particular implementation chosen.

FIG. 6C illustrates the left shoulder strap 104 having a first strap 140, a second strap 142, a padded central portion 144, and a pair of strap adjustment means 146, 148. The first strap 140 is provided for attachment to the golf bag at the top hook 118 of the golf bag. The second strap 142 is provided for attachment to the hip belt member at the second attachment point 114, as well as to the central portion of the bag at the central hook 116. As with the right shoulder strap 102, the left shoulder strap 104 has a first and second strap adjustment means 146, 148 for adjusting respectively the lengths of the first and second straps. The padded central portion 144 has a flat side 150 and an arcuate side 152, the flat side intended to be placed on the user's shoulder towards the neck, while the arcuate side is intended to be placed on the user's shoulder towards the arm. While FIGS. 5 and 6A–6C show a triglide® type buckle(-type) or ladderloc® buckle adjustment means at 130, 132, 146, and 148, it will be understood that other suitable adjustment means may be used at various locations along the strap for adjusting and securing the length of straps 122, 124, 140 and 142.

Figure 7:
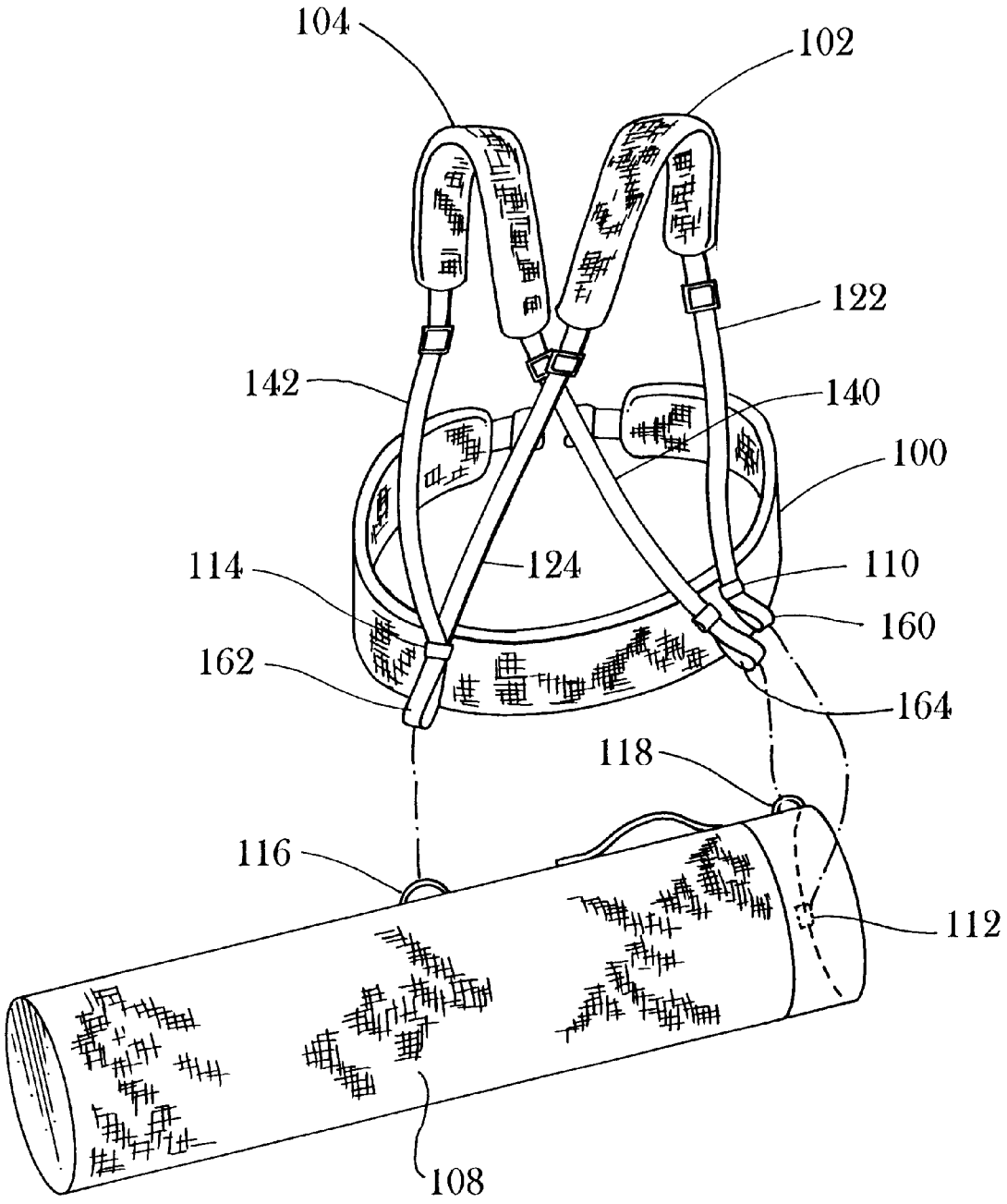
FIG. 7 illustrates a rear view of the alternative embodiment of FIG. 5 showing the attachment points of the inventive system to a golf bag.

FIG. 7 illustrates a rear view of the shoulder strap system and the hip belt member in accordance with the present invention. The right shoulder strap 102 is attached to the hip belt member 100 in two locations. The first strap 122 of the right shoulder strap is attached at the first attachment point 110, while the second strap 124 of the right shoulder strap is attached at the second attachment point 114 of the hip belt member. The first strap forms a first loop 160 at the first attachment point 110 for connection to the side attachment point 112 of the golf bag. The second strap 124 of the right shoulder strap forms a second loop 162 at the second attachment point 114 for attachment to the central hook 116 of the golf bag.

The left shoulder strap 104 is attached to the hip belt member 100 and to the golf bag 108. The first strap 140 of the left shoulder strap forms at its end a third loop 164 for attachment to the top hook 118 of the golf bag. The second strap 142 of the left shoulder strap is attached to the second attachment point 114 of the hip belt member and can also form a second loop 162 for attachment to the central hook 116 of the golf bag. In this unique attachment configuration, this embodiment of the present invention transfers the weight of the golf bag to the user's hips while properly orienting the bag and stabilizing the bag from unwanted movement or rotation.

Figure 8A:
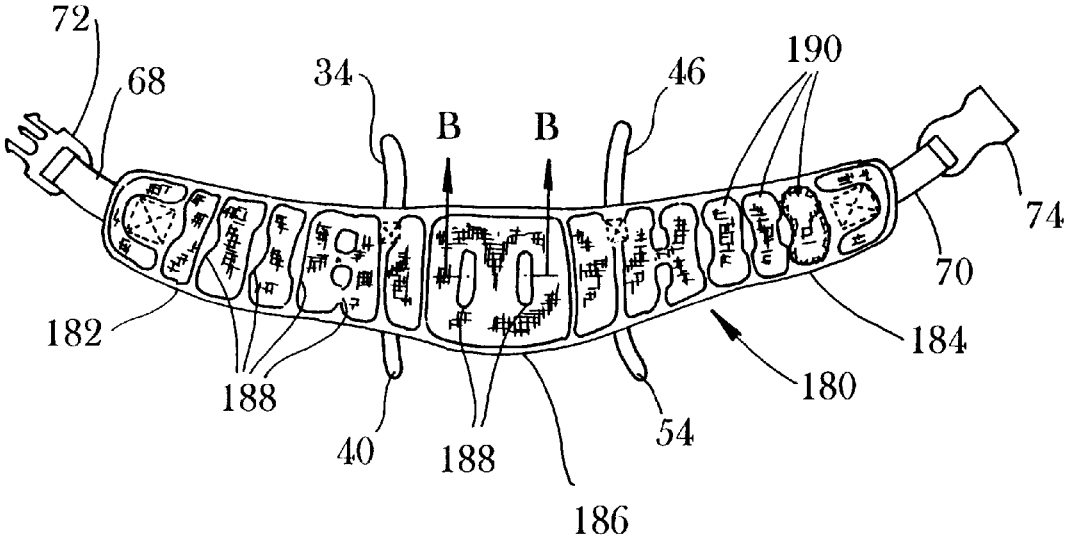
FIG. 8 illustrates a hip belt made of molded foam with vent slots.
Figure 8B:
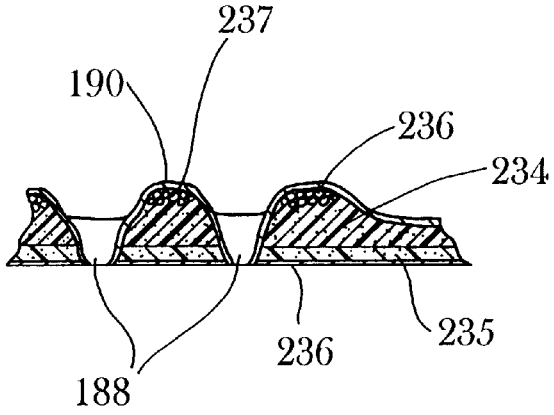

FIG. 8A illustrates another embodiment of the present invention wherein the padded hip belt 180 is provided with vent slots 188 to allow air to pass through to improve the user's comfort during hot weather. This hip belt 180 is shown with a first hip portion 182, a second hip portion 184, and a central portion 186. The belt 180 is shown with molded fabric covered foam pillows 190 and vent slots 188 located between the pillows. The belt has the same buckles 72 and 74 and the same straps 34, 40, 46, and 54 as the earlier versions of the belt, for example that shown in FIG.2. In FIG. 8B a longitudinal section view is shown showing the pillows 190, vent slots 188, cover fabric 236, soft molded foam 234 against the users body and denser foam 235 along the back surface to add stiffness to help prevent the belt from curling. For the soft molded foam 234, a ½ inch thick layer of 2 lb/ft3 polyethylene foam with a terry cloth cover fabric 236 has been found to be effective. For the denser foam 235 a ¼ inch thick layer of 6 lb/ft3 polyethylene foam with a stiff 600D polyester fabric cover has been found to be effective.

Figure 9A:
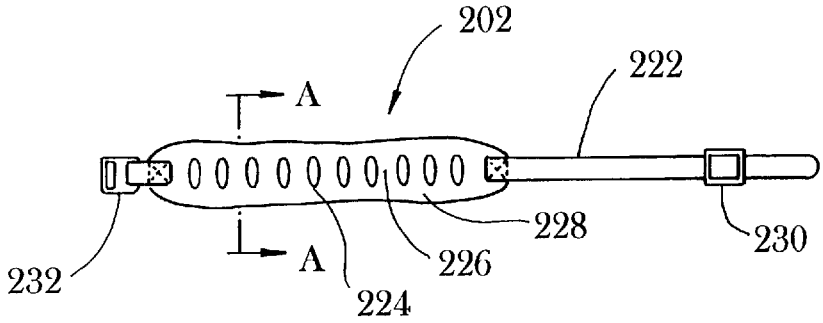
FIG. 9A illustrates a shoulder strap of molded foam and open mesh with vent slots.
Figure 9B:
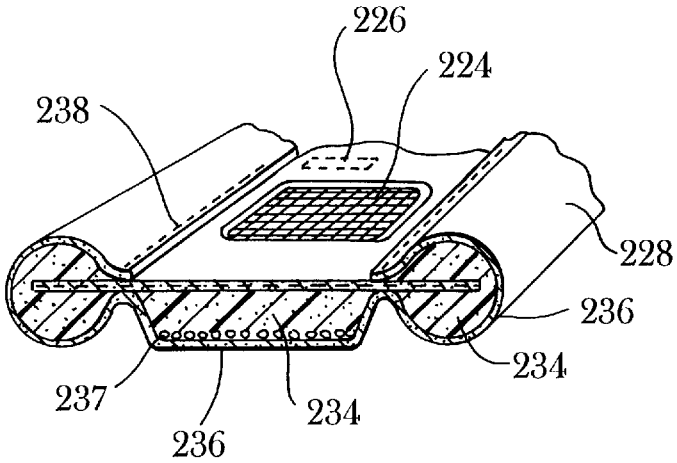
FIG. 9B illustrates a section view of the padded portion of the vented shoulder strap.
Figure 9C:
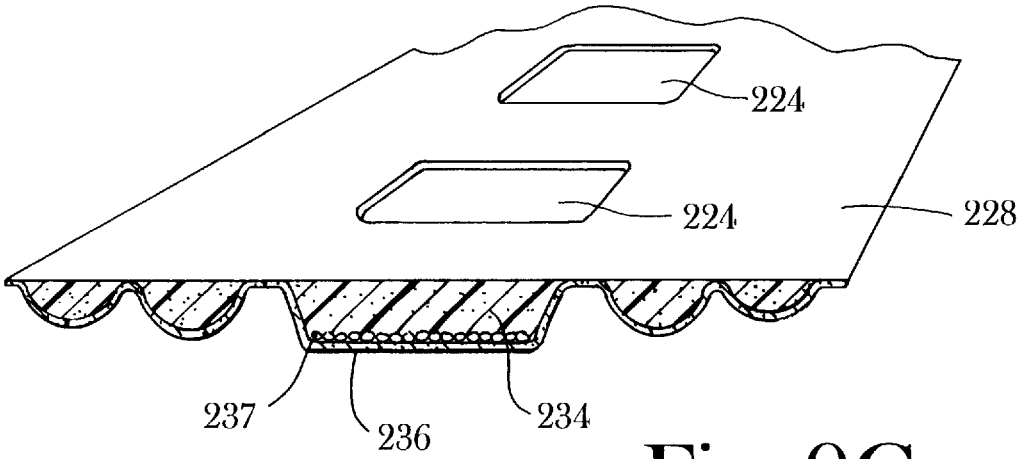
FIG. 9C illustrates an unfolded view of the vented shoulder pad.

FIG. 9A illustrates a vented shoulder pad and strap 202 that allows some air to pass through the padded portion 228 while being worn to improve the users comfort during hot weather. The padded portion 228 is made of molded fabric covered foam with vent holes or slots 224, open woven mesh 226, ladder lock buckle 232 on one end and strap 222 on the other end with adjustable triloc® buckle 230. A section through the padded portion 228 is shown in FIG. 9B, where soft molded foam 234 has fabric cover 236, vent slots 224 and open mesh 226. The open mesh 226, which extends along the length and over the vent slots 224 adds strength to the padded portion 228 while allowing air to freely pass through the slots. The open mesh 226 is sewn along its edges 238. FIG. 9C illustrates an unfolded section view of the molded foam member 228 shown flattened as it is after manufacturing and before it is folded over the open mesh 226. This type of construction is commonly referred to as a clam shell design. In FIG. 9C the foam 234 with fabric cover 236 has vent slots 224 formed into it periodically along its length. For the soft molded foam 234 a ½ inch thick layer of 2 lb/ft3 polyethylene foam with a pique or mouton fabric cover has been found to be effective.

Another feature may be added to the invention to increase the user's comfort during hot weather. By adding a thin layer or coating of heat storing material 237 to the surfaces of the molded foam pillows 190 and/or fabric 236 of the hip belt 180 and shoulder pads 228 where they contact the user, these surfaces will feel cool to the user. When the belt and shoulder pads are not being worn, these surfaces will cool to ambient temperature, particularly if placed in the shade. Further, any sweat that has been absorbed by these surfaces will evaporate, when they are not being worn, and further cool the heat storing material to a temperature below ambient. Then when the belt and shoulder pads are worn, they will absorb heat and provide cooling to the user. A heat storage material 237 such as Isogel® polyurethane elastomer has a large heat capacity and ability to store sensible heat and may be made in granular form so it may be incorporated into the surface of the foam pillows 190. A heat storing material 237, such as a low melting point paraffin that changes phase from solid to liquid when heated, may also be encapsulated in small spheres, for example, and incorporated into the surface of the foam pillows 190. Further, a heat storing material may be coated on the fabric 236 where it contacts the user to absorb heat from the user and reject it to the surrounding air.

Figure 10:
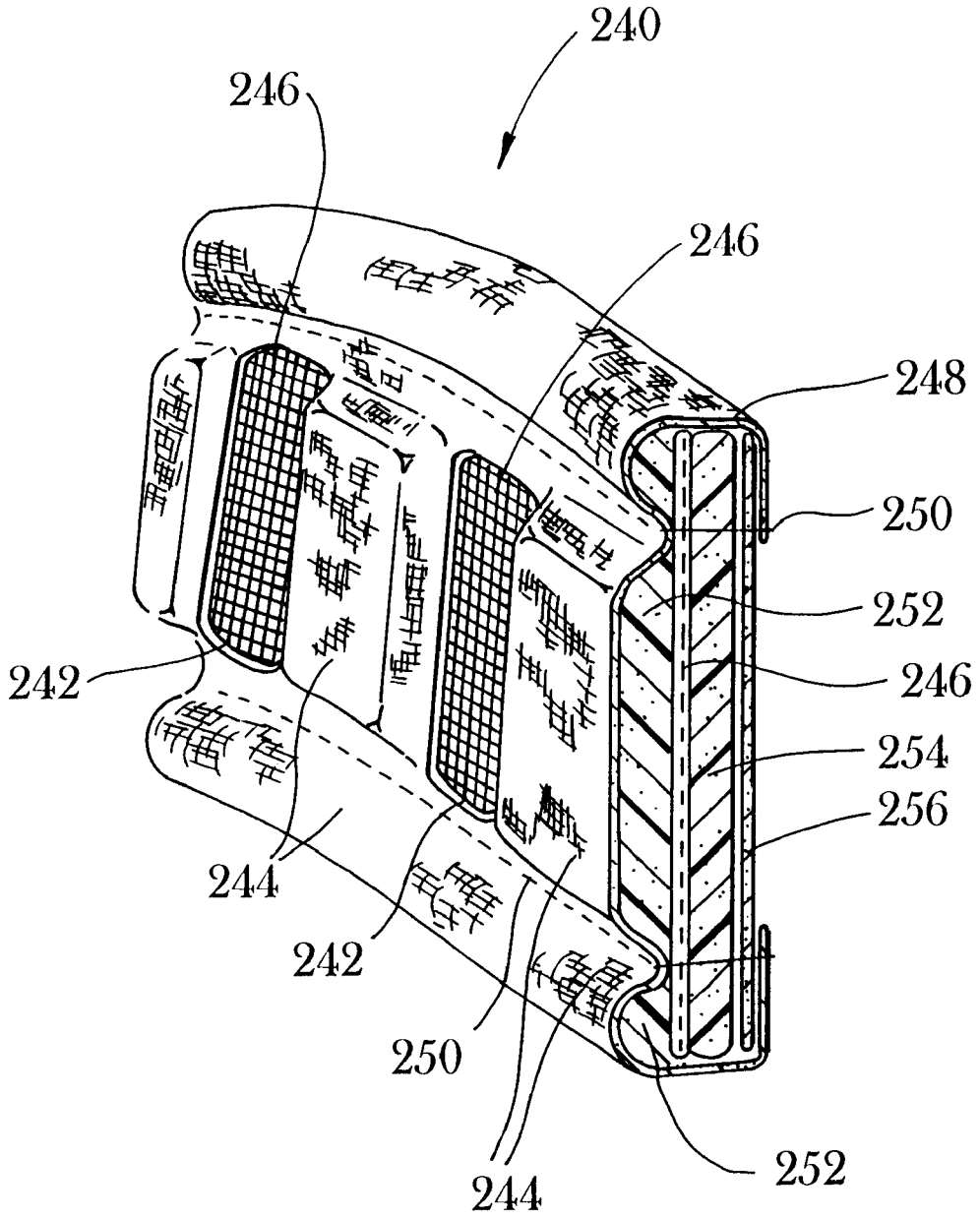
FIG. 10 illustrates a perspective cross section drawing of a vented hip belt made by a "clam shell" method.

The hip belt may also be made using a clam shell design. FIG. 10 illustrates a hip belt of the clam shell design where the hip belt member 240 includes a soft molded foam portion 252 with fabric cover 248. Vent holes 242 are formed periodically in the belt between molded foam pillows 244. An open mesh 246 extends the length of the belt 240 and covers the vent holes 242 to add strength while allowing air to pass through the holes for ventilation. A dense foam backing 254 is added to provide stiffness and strength to the belt 240. An optional stiffener backing material 256 may be added to provide increased stiffness, particularly in the areas where the attachments create the greatest stress concentration. The belt 240 is sewn along the edges 250 of the mesh 242 to hold the molded foam 252, the mesh 242 the dense foam 254 and the backing material 256 in place. It has been found that a ½ inch thick layer of 2 lb/ft3 polyethylene foam with terry cloth cover is effective for the soft molded foam 252 with cloth cover 248. A nylon mesh with ⅛ inch mesh size has been found to be effective for the woven open mesh 246. For the denser foam 254 a ¼ inch thick layer of 4 to 6 lb/ft3 polyethylene foam has been found to be effective. For the stiff backing material 256 a 2 mm thick high density polyethylene material has been found to be effective.

Figure 11:
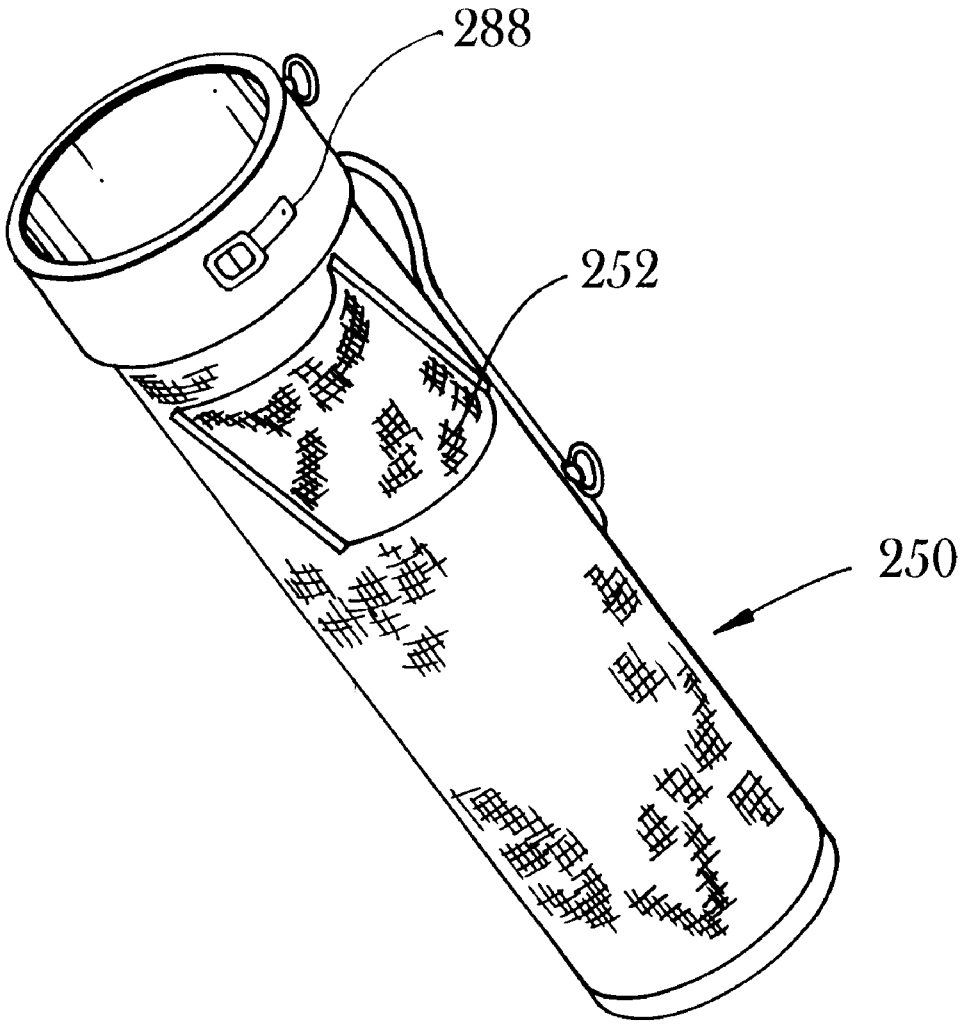
FIG. 11 illustrates a golf bag fitted with a slot pocket into which the hip belt may be fitted.

FIG. 11 illustrates an alternate attachment method between the hip belt and the golf bag wherein the hip belt is fitted into a slot or pocket 252 attached to the side of the golf bag 250. The advantage of this method of attachment is that the belt may be easily installed by simply sliding it in or out of the slot. The hip belt may also have straps and buckles 288 to aid in attaching it to the bag. The slot or pocket 252 may be made of fabric sewn to the bag 250 along its top and bottom edges or it may be sewn on just one edge, say the top edge, and the bottom edge may be attached to the bag 250 by buckles, snaps other attachment means.

Figure 12:
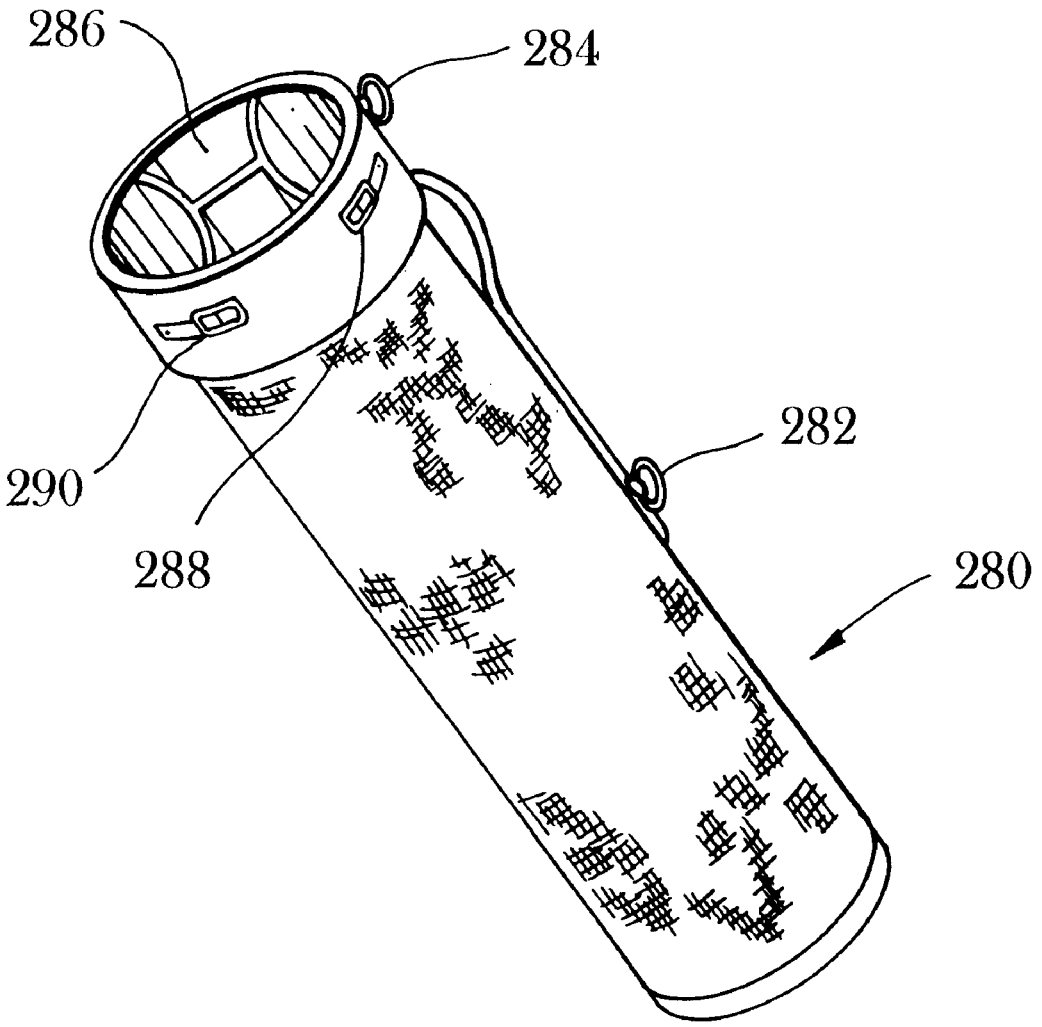
FIG. 12 illustrates a golf bag fitted with buckles to accommodate the hip belt and shoulder straps.

FIG. 12 illustrates a golf bag that is provided with buckles and hooks for attachment to the hip belt and dual shoulder strap system of the present invention, shown in FIGS. 1, 2, 5 and 7. A golf bag 280 with open top 286 is shown with a central hook 282, a top hook 284, and two side attachment buckles 288 and 290. The straps of the hip belt shown in FIG. 2, for example, would attach to the bag 280 by attaching strap 34 to buckle 288, strap 40 to buckle 290, and straps 46 and 58 to hook 282. By using two buckles 288 and 290 on the bag 280 a more secure and stable attachment is made between the hip belt and the bag which reduces bouncing of the bag while walking. The dual shoulder straps may also be attached to the belt and bag as shown in FIG. 7.

Using the present invention, the golf bag is carried in an orientation, which is substantially horizontal with the open end of the golf bag angled upwards. The golf clubs, golf balls and other accessories are readily accessible to the golfer, and the golfer can easily bend over to pick up golf balls or tees, fix a ball mark on the green, drink from a water fountain, or tie shoelaces, for example. Further, since the hip belt member is easily detachable, the golfer can remove the hip belt member, and any associated shoulder straps, from his or her body before each golf shot to enjoy a natural golf swing unencumbered by any golf bag carrying apparatus. The hip belt transfers most of the weight of the golf bag to the user's hips, provides back support and serves as a cushion between the bag and the user's back.

While the hip belt member of the present invention and the shoulder support system of the present invention have been shown in conjunction with a golf bag as a weight-bearing object, it is understood that the present invention could be adapted to carry other weight-bearing objects, such as, for example, a musical instrument (i.e., a bass drum or set of drums, a xylophone, an upright tuba), tools (i.e., gas powered leaf blowers, portable vacuums, chain saws), cameras and video equipment including their battery packs, military equipment (i.e., guns, radios), or small children in a suitable infant seat carrier, without departing from the scope of the present invention.

While the invention has been particularly shown and described with reference to a preferred embodiment thereof, it will be understood by those skilled in the art that various other changes in the form and details may be made without departing from the spirit and scope of the invention.

I claim:

1. An apparatus for carrying a golf bag having first and second spaced apart attachment points, comprising:

a hip belt member for supporting said golf bag behind a user about the user's hips, having a central portion, a first hip portion, and a second hip portion;

a first waist strap coupled to said first hip portion;

a second waist strap coupled to said second hip portion;

a quick-release clasp for connecting said first waist strap to said second waist strap about the user's waist to facilitate rapid putting on and taking off of the apparatus including the hip belt member;

first and second attachment members coupled to said first and second hip portions of said hip belt member to attach to first and second attachment points on said golf bag, said first and second attachment members being spaced to position the weight of the golf bag therebetween behind the user and distribute the load onto the hips of the user; and a shoulder strap connectable at least on one end to said golf bag and adapted to be worn concurrently with said hip belt member.

2. The apparatus of claim 1, wherein said shoulder strap is connectable at another end to said golf bag.

3. The apparatus of claim 1, wherein said shoulder strap is attached at another end to said hip belt member.

4. The apparatus of claim 1, wherein said hip belt member is padded along the central portion.

5. The apparatus of claim 1, wherein said first waist strap is adjustable in length in front of the user to adjustably fit the user's hips.

6. The apparatus of claim 1, wherein said quick-release clasp is a bayonet-type snap clasp having a male end and a female end.

7. The apparatus of claim 1, wherein said first attachment member comprises an adjustable fastener attached to said hip belt member at a first attachment point on said first hip portion and said second attachment member comprises an adjustable fastener attached to said hip belt member at a second attachment point on said second hip portion.

8. The apparatus of claim 1, wherein hip belt comprises padding.

9. The apparatus of claim 8, wherein said padding comprises a low density foam on a side contacting the user and at least one layer of higher density foam on another side.

10. The apparatus of claim 8, further comprising a layer of solid stiff backing material along a back side of said hip belt.

11. The apparatus of claim 8, wherein said hip belt has vent holes between padded pillows.

12. The apparatus of claim 8, further comprising a fabric covering on said hip belt.

13. The apparatus of claim 8, wherein said hip belt is folded around an open mesh and sewn along its edges.

14. The hip belt of claim 1, wherein a layer of heat storing material is added to surfaces that contact the user to absorb heat while being worn and reject heat to the ambient air by convection and by evaporation when not being worn.

15. The hip belt of claim 14, wherein said layer of heat storing material comprises a sensible material.

16. The hip belt of claim 14, wherein said layer of heat storing material comprises a phase changing material.

17. An apparatus for carrying a golf bag, comprising:

a hip belt member for supporting said golf bag, said hip belt member having a first end and a second end;

a quick-release fastener for connecting said first end to said second end about a user's waist to position the golf bag behind the back of the user to enable rapid putting on and taking off of the apparatus including the hip belt member;

two attachment members coupled to said hip belt member for attaching said hip belt member to said golf bag at two distinct locations on the golf bag; and a shoulder strap connectable at least at one end to said golf bag and adapted to be worn concurrently with said hip belt member.

18. The apparatus of claim 17, wherein said shoulder strap is attachable at another end to said golf bag.

19. The apparatus of claim 17, wherein said shoulder strap is attached at another end to said hip belt member.

20. The apparatus of claim 17, wherein said two attachment members comprise sewn stitches.

21. The apparatus of claim 17, wherein said two attachment members comprise buckles attachable to said golf bag.

22. A system for carrying a golf bag, comprising:

a hip belt member for supporting said golf bag, said hip belt member having first and second ends;

a quick release fastener for connecting said first end to said second end about a user's waist to enable rapid putting on and taking off of the system including the hip belt member;

two attachment members coupled to said hip belt member for attaching said hip belt member to said golf bag at two distinct spaced apart locations to position the load of the golf bag therebetween behind the user and distribute the load onto the hips of the user, said first attachment member coupling said hip belt member to a top portion of said golf bag at a first attachment point; and said second attachment member coupling said hip belt member to a central portion of said golf bag at a second attachment point; and shoulder strap for lifting and stabilizing said golf bag about the user, said shoulder strap having one end connected to said golf bag and another end connected to said hip belt member adapted to be worn concurrently with said hip belt member.

23. The system of claim 22, wherein said shoulder strap comprises:

a first shoulder strap having a central portion, a first strap for attachment to said first attachment point, and a second strap for attachmnent to said second attachment point; and a second shoulder strap having a central portion, a first strap for attachment to said golf bag at a point along the top of said golf bag, and a second strap member for attachment to said second attachment point .

24. The system of claim 23, wherein said first shoulder strap has a slot member positioned along said first strap for defining a slot, said slot adapted to receive said first strap of said second shoulder strap.

25. The system of claim 23, wherein said shoulder strap comprises a padded portion and a fabric cover on at least an outer side, said shoulder strap having vent holes between padded pillows.

26. The system of claim 25, wherein said shoulder strap is folded around an open mesh and sewn along its edges.

27. The system of claim 22, wherein a layer of heat storing material is added to surfaces that contact the user to absorb heat while being worn and rejected heat to the ambient air by convection and by evaporation when not being worn.

28. The system of claim 27, wherein said layer of heat storing material comprises a sensible material.

29. The system of claim 27, wherein said layer of heat storing material comprises a phase changing heat material.

30. A golf bag apparatus, comprising:

a golf bag;

a hip belt member for supporting said golf bag, said hip belt member having a first end and a second end;

a quick-release fastener for connecting said first end to said second end about a user's waist to position the golf bag behind the back of the user to enable rapid putting on and taking off of the apparatus including the hip belt member;

two attachment members coupled to said hip belt member for attaching said hip belt member to said golf bag at two distinct locations on the golf bag; and a shoulder strap connected at least at one end to said golf bag adapted to be worn concurrently with said hip belt member.

31. The apparatus of claim 30, wherein said shoulder strap is attached at another end to said golf bag.

32. The apparatus of claim 30, wherein said shoulder strap is attached at another end to said hip belt member.

33. The apparatus of claim 30, wherein said two attachment members comprise sewn stitches.

34. The apparatus of claim 30, wherein said two attachment members comprise two edges of a pocket attached to a side of a golf bag at its center of gravity for receiving the hip belt member.

35. The apparatus of claim 30, wherein said two attachment members comprise a pocket attached to a side of the golf bag at its center of gravity for receiving the hip belt member and at least one additional attachment member.

36. The apparatus of claim 30, wherein said two attachment members comprise buckles attached to said bag.

* * * * *